US007871144B2

(12) United States Patent
Kim

(10) Patent No.: US 7,871,144 B2
(45) Date of Patent: Jan. 18, 2011

(54) INKJET IMAGE-FORMING APPARATUS AND METHOD THEREOF

(75) Inventor: Young-choon Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 429 days.

(21) Appl. No.: 11/962,506

(22) Filed: Dec. 21, 2007

(65) Prior Publication Data

US 2008/0278528 A1 Nov. 13, 2008

(30) Foreign Application Priority Data

May 7, 2007 (KR) ..... 10-2007-0044232

(51) Int. Cl.
*B41J 29/393* (2006.01)

(52) U.S. Cl. ..... 347/19

(58) Field of Classification Search ..... 347/19, 347/101, 105, 14, 104
See application file for complete search history.

(56) References Cited

U.S. PATENT DOCUMENTS 5,581,284 A * 12/1996 Hermanson ..... 347/43
6,095,637 A * 8/2000 Hirabayashi et al. ..... 347/43
6,802,580 B2 * 10/2004 Valero ..... 347/1

* cited by examiner

*Primary Examiner*—Lamson D Nguyen
(74) *Attorney, Agent, or Firm*—Stanzione & Kim, LLP

(57) ABSTRACT

An inkjet image-forming apparatus includes an array inkjet head that is formed along a printing path through which a paper on which an image or a test image is formed is discharged, and includes a length corresponding to the width of the paper, and a plurality of nozzles to eject ink, and a missing nozzle detection unit formed along a missing nozzle detection path that is connected to the printing path to scan an image or a test image formed by the array inkjet head by transporting the paper (P), on which the test image is formed, towards the printing path, and a method thereof.

20 Claims, 9 Drawing Sheets

INKJET IMAGE-FORMING APPARATUS AND METHOD THEREOF

CROSS-REFERENCE TO RELATED APPLICATIONS

This application claims priority under 35 U.S.C. §119(a) from Korean Patent Application No. 10-2007-0044232, filed on May 7, 2007, in the Korean Intellectual Property Office, the disclosure of which is incorporated herein in its entirety by reference.

BACKGROUND OF THE INVENTION

1. Field of the Invention

The present general inventive concept relates to an inkjet image-forming apparatus, and more particularly, to an inkjet image-forming apparatus having a missing nozzle detection device that can detect a printing-failure region of an array inkjet head, and a method thereof.

2. Description of the Related Art

Conventional inkjet image-forming apparatuses form an image on a paper by ejecting ink from a printing head (e.g., a shuttle type printing head) that reciprocally travels in a perpendicular direction (i.e., in a widthwise direction) to a moving direction of the paper by being separated a predetermined distance apart from an upper surface of the paper. The printing head includes a nozzle unit on which a plurality of nozzles that eject ink are formed.

Recently, attempts have been made to perform high speed printing using an array inkjet head that includes a nozzle unit having a length corresponding to a width of the paper instead of using the printing head that reciprocally travels in the widthwise direction. In an image-forming apparatus using an array inkjet head, since the array inkjet head is fixed and the paper moves relative to the array inkjet head, a driving device of the image-forming apparatus using an array inkjet head is simple, and thus, high speed printing can be performed.

In the image-forming apparatus using the array inkjet head, the array inkjet head has a width corresponding to the width of the paper. Therefore, if there are any defective nozzles among the nozzles of the nozzle unit, a portion of an image corresponding to the defective nozzles cannot be properly formed on the paper.

In order to address such image degradation due to the defective nozzles, a method of automatically compensating for an image degradation of the image forming apparatus or a method of correcting the image using a nozzle adjacent to the defective nozzle can be performed.

Prior to performing a method of solving the image degradation problem caused by defective nozzles, it is necessary to detect the defective nozzles of the nozzles of the array inkjet head.

Accordingly, it is essential for the inkjet image-forming apparatus using an array inkjet head to have a missing nozzle detection device for detecting such defective nozzles.

SUMMARY OF THE INVENTION

The present general inventive concept provides an inkjet image-forming apparatus that includes a missing nozzle detection device to detect defective nozzles of an array inkjet head.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an inkjet image-forming apparatus including an array inkjet head that is formed along a printing path through which a paper on which an image or a test image is formed is discharged, includes a length corresponding to a width of the paper, and has a plurality of nozzles to eject ink, and a missing nozzle detection unit that is formed on a missing nozzle detection path that is connected to the printing path to scan a test image formed by the array inkjet head by transporting the paper on which the test image is formed towards the printing path.

The missing nozzle detection unit may include a scan unit that scans the test image, a pushing unit formed along a lower side of the scan unit to push the paper towards the scan unit, and a plurality of transport roller units which respectively are formed on either side of the scan unit and are installed to be able to move the paper in both front and rear directions.

The foregoing and/or other aspects and utilities of the present general inventive concept may also be achieved by providing an inkjet image-forming apparatus, including an array inkjet head including a plurality of nozzles to form an image on a printing medium, a missing nozzle detection unit to scan the image formed on the printing medium, and a control unit to compare the scanned image with a stored image and to perform a compensation operation on the array inkjet head to correct the image formed on the printing medium if the scanned image does not correspond to the stored image.

The comparison of the scanned image to the stored image may result in a determination of which of the plurality of nozzles is defective.

A nozzle corresponding to a location of the scanned image which does not correspond to the stored image may be defective.

The compensation operation may include shifting the array inkjet head in a predetermined direction such that an operational nozzle replaces the defective nozzle.

The array inkjet head may print the image onto the printing medium when the printing medium is fed in a first direction, and the missing nozzle detection unit may scan the image printed on the printing medium when the printing medium is fed in a second direction.

The inkjet image-forming apparatus may further include a paper size detection unit to detect at least one of a length and a width of the printing medium.

The paper size detection unit may send information corresponding to at least one of the length and the width of the printing medium to the control unit such that the control unit differentiates which of the plurality of nozzles are out of a range of the at least one of the length and the width of the paper.

The foregoing and/or other aspects and utilities of the present general inventive concept may also be achieved by providing a method of detecting a defective nozzle among a plurality of nozzles in an array inkjet head of an image forming apparatus, the method including feeding a printing medium in a first direction toward the array inkjet head to form an image thereon, feeding the printing medium in a second direction toward a missing nozzle detection unit to scan the image formed on the printing medium, determining whether the scanned image corresponds to a stored image, and performing a compensation operation on the array inkjet head to correct the image formed on the printing medium.

The method may further include feeding the printing medium in the first direction to form the corrected image thereon and ejecting the printing medium outside the image forming apparatus.

The determining of whether the scanned image corresponds to the stored image may include determining which location of the scanned image does not correspond to the stored image, and determining which of the plurality of nozzles corresponds to the location of the scanned image which does not correspond to the stored image.

The compensation operation may include shifting the array inkjet head in a predetermined direction such that an operational nozzle replaces the defective nozzle.

The foregoing and/or other aspects and utilities of the present general inventive concept may also be achieved by providing an image forming apparatus, including an array inkjet head disposed on a path to form an image on a printing medium and a detection unit disposed on the path to scan the image of the printing medium.

The path may include a printing path along which the printing medium is fed toward the array inkjet head to form the image, and away from the array inkjet head to be discharged and a missing nozzle detection path extended from the printing path to scan the image of the printing medium and to discharge the printing medium.

The image forming apparatus may further including a roller to direct the printing medium to the detection unit from the inkjet head.

The detection unit may include a scanner to scan the image.

The path may include a first path to feed the printing medium from a paper cassette to the array inkjet head, a second path extended from the first path to from the image on the printing medium, a third path extended from the second path to discharge the printing medium, and a fourth path extended from the second path such that the detection unit scans the image.

The fourth path may a portion of the first path.

The fourth path may be extended from the second path in a direction opposite to the third path.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
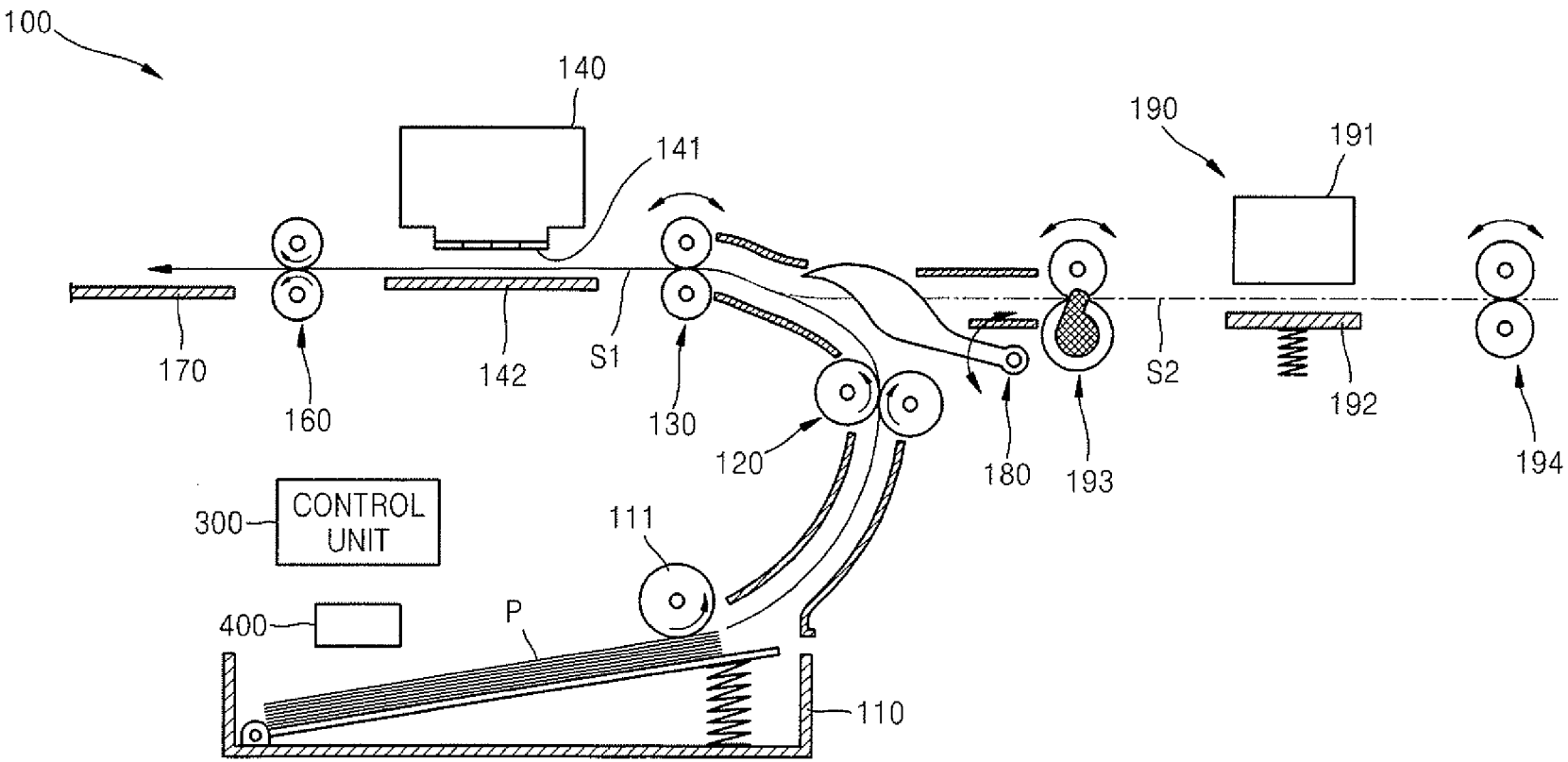
FIG. 1 is a schematic cross-sectional view of an inkjet image-forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
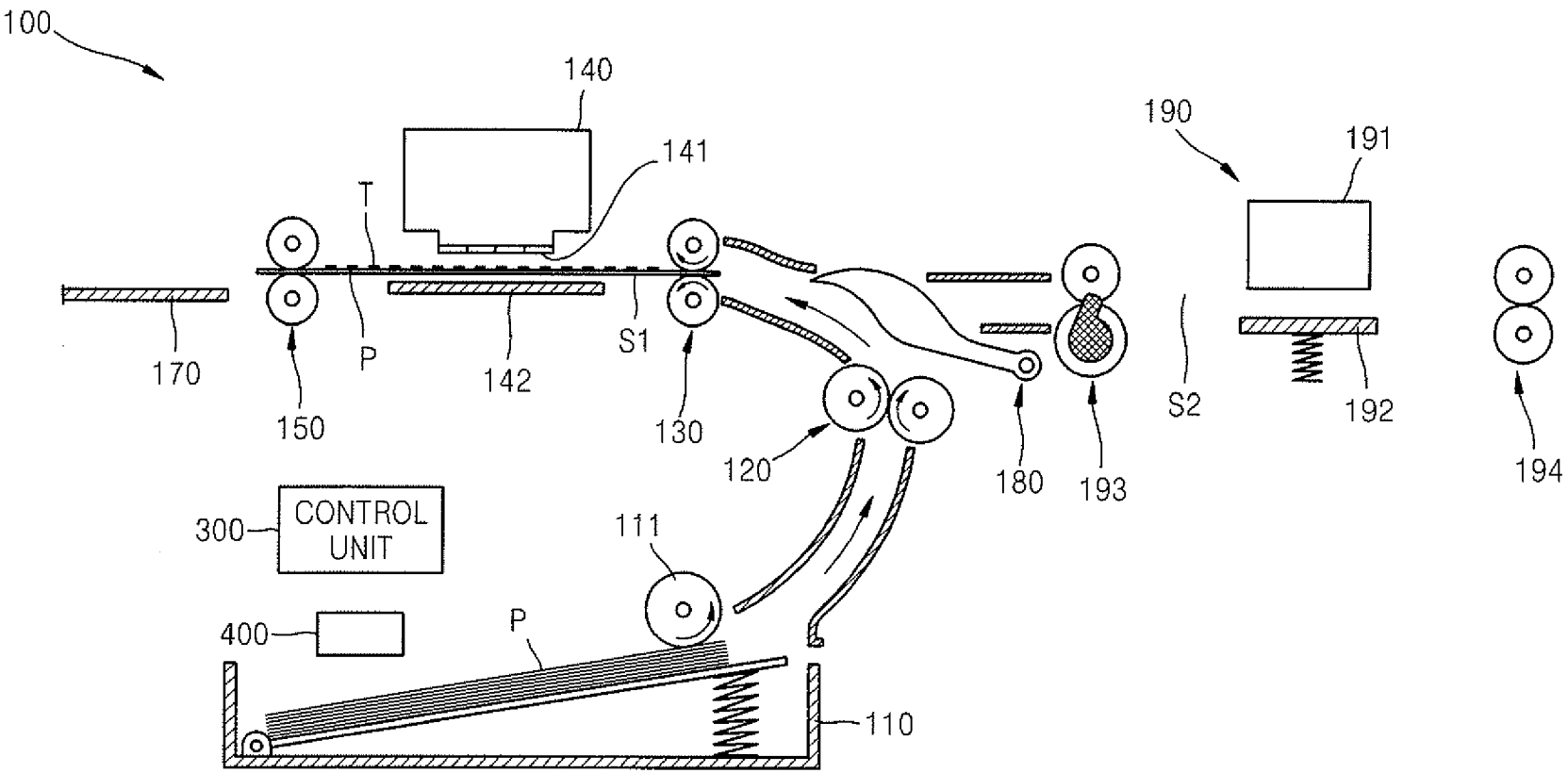
FIGS. 2 through 4 are schematic cross-sectional views illustrating a scanning operation of a test image using a missing nozzle detection unit of FIG. 1, according to an embodiment of the present general inventive concept.
Figure 3:
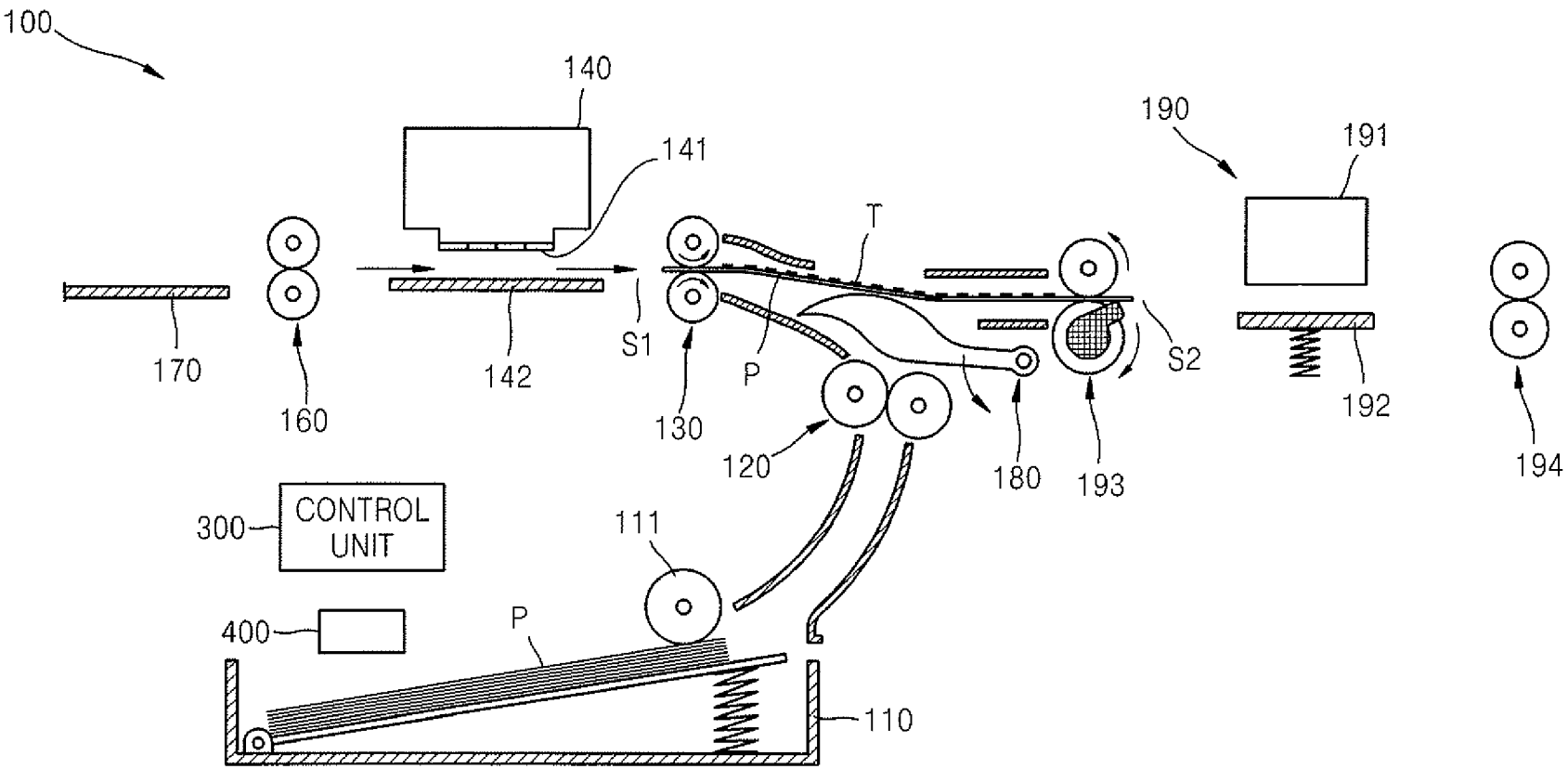
Figure 4:
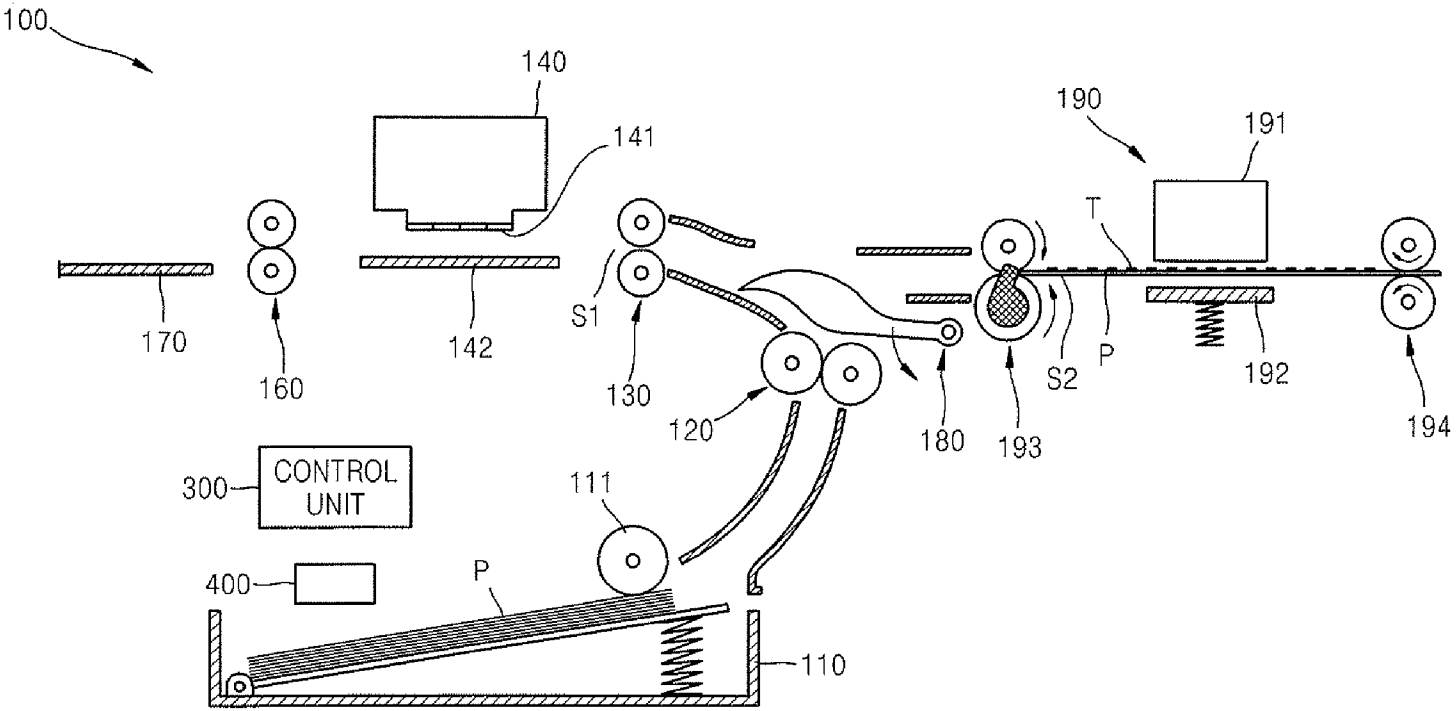

FIG. 1 is a schematic cross-sectional view of an inkjet image-forming apparatus 100 according to an embodiment of the present general inventive concept. FIGS. 2 through 4 are schematic cross-sectional views illustrating a scanning operation of a test image using a missing nozzle detection unit 190 of FIG. 1, according to an embodiment of the present general inventive concept.

Referring to FIG. 1, the inkjet image-forming apparatus 100 includes a cassette 110, an array inkjet head 140, a pair of discharge rollers 160, a guide unit 180, and the missing nozzle detection unit 190.

The cassette 110 contains a plurality of papers P (i.e., printing media), and a pick-up roller 111 that picks up each of the sheet of papers P is formed on an upper side of the cassette 110. A paper P, picked-up by the pick-up roller 111, is moved along a printing path S1 to print an image on the paper P. A pair of first transport rollers 120, a pair of second transport rollers 130, the array inkjet head 140, and the pair of discharge rollers 160 are sequentially disposed along the printing path S1.

The second transport rollers 130 of the pair of second transport rollers 130 contact each other, are disposed close to the array inkjet head 140, and may have a registration function to align the paper P. The pair of second transport rollers 130 is installed to be able to transport the paper P in both front and rear directions so that the pair of second transport rollers 130 can also transport the paper P towards the missing nozzle detection unit 190, as will be described later.

The array inkjet head 140 has a length corresponding to a width of the paper P, and includes a plurality of nozzles 141 to eject ink. A supporter 142 that supports the moving paper P is provided on a lower side of the array inkjet head 140 which is fixed, and thus, an image is printed on the paper P by ejecting ink from the nozzles 141 while the paper P passes under the array inkjet head 140.

The discharge rollers 160 discharge the paper P, on which an image is printed, to the outside to stack the printed-upon paper P on a paper deck 170.

In a normal printing operation to form an image on a paper P, the image is formed on the paper P picked up by the pick-up roller 111 from the cassette 110 while the paper P is transported under a lower surface of the array inkjet head 140 by the pair of first transport rollers 120 and the pair of second transport rollers 130. The paper P, on which an image is formed, is discharged by the pair of discharge rollers 160 so as to be stacked on the paper deck 170.

The missing nozzle detection unit 190 is disposed along a missing nozzle detection path S2 that is connected to the printing path S1. The missing nozzle detection unit 190 scans a test image T, and includes a scan unit 191 that scans the test image T, a pushing unit 192 that is formed on a lower side of the scan unit 191 to push the paper P, on which the test image T is formed, towards the scan unit 191, and a pair of transport rollers 193 and 194 respectively formed on either side of the scan unit 191.

The transport rollers 193 and 194 of each of the pairs of transport rollers 193 and 194 contact each other and may be installed to be able to move the paper P in both front and rear directions. The pair of transport rollers 193, disposed closer to the printing path S1, may be able to perform a registration function to align the paper P.

The guide unit 180 is disposed at a point where the printing path S1 and the missing nozzle detection path S2 are connected to each other to guide the paper P picked up by the pick-up roller 111 towards the array inkjet head 140 or towards the missing nozzle detection unit 190 when the test image T is formed on the paper P.

An operation of the missing nozzle detection unit 190 will now be described with reference to FIGS. 2 through 4. FIGS. 2 through 4 are schematic cross-sectional views illustrating a scanning operation of the test image T using the missing nozzle detection unit 190 of FIG. 1, according to an embodiment of the present general inventive concept.

Referring to FIG. 2, a paper P picked up by the pick-up roller 111 is transported along the printing path S1 by the pair of first transport rollers 120 and the pair of second transport rollers 130, and a test image T is formed on the paper P while the paper P passes under the array inkjet head 140. At this point, after the paper P has been passed under the array inkjet head 140, an end of the paper P, on which the test image T is formed, may be inserted between the pair of second transport rollers 130.

Referring to FIG. 3, the paper P, on which the test image T is formed, is transported in an opposite direction by rotating the pair of second transport rollers 130 in a reverse direction. At this point, the guide unit 180 guides the paper P, on which the test image T is formed, along the missing nozzle detection path S2. The scan unit 191 does not scan the paper P on which the test image T is formed as the paper P passes under the scan unit 191. The pair of transport rollers 194 stop rotating when the transport rollers 194 hold an end of the paper P on which the test image T is formed.

Referring to FIG. 4, the pair of transport rollers 194 rotates in a reverse direction to transport the paper P, on which the test image T is formed, towards the scan unit 191. The scan unit 191 reads the test image T formed on the paper P. The pair of transport rollers 193 transports the paper P towards the printing path S1 after aligning the paper P.

The paper P including the test image T of which has been read by the scan unit 191, is guided along the printing path S1 by the guide unit 180 and the pair of second transport rollers 130, and is stacked on the paper deck 170 by being discharged to the outside by the pair of discharge rollers 160.

If there is a portion of the test image T that is not read by the scan unit 191, a control unit 300 recognizes the portion of the test image T that is not read by the scan unit 191 as a defective portion of the nozzles, and thus, performs a calibration operation in response to the detected defective portion of the nozzles 141. More specifically, after the scan unit 191 reads the test image T from the paper P, the control unit 300 can compare the test image T read by the scan unit 191 to a test image T stored in a storage device (not illustrated). If, for example, pixels of the scanned image do not correspond to pixels of the image read from the storage device, the control unit 300 determines that a misprint has occurred due to a defective nozzle 141 or portion of nozzles 141. Accordingly, an exact defective nozzle 141 or portion of nozzles 141 is found by the control unit 300 by matching the misprinted portion of the scanned image to a corresponding location of the defective nozzle 141 or portion of nozzles 141. The calibration operation may include any operation corresponding to correcting the misprint, including shifting the nozzles 141, increasing ink ejected from properly-operating nozzles 141, or any other type of calibration operation well known in the art. Furthermore, the storage device may be, but is not limited to, a computer memory, a disk, a flash-memory, or any other type of computer storage device well known in the art.

A paper size detection unit 400 may also be included to detect a size of the paper P. The paper size detection unit 400 may measure a length and a width of the paper P, and send information corresponding to the length and the width of the paper P to the control unit 300. Accordingly, the control unit 300 will not expect ink to be ejected from nozzles 141 which are outside of a range of the size of the paper P. Accordingly, if a user inserts various-sized paper P in the image forming apparatus 100, the control unit 300 will be able to differentiate which of the nozzles 141 are actually defective, and which of the nozzles 141 are not being used intentionally. Therefore, various sizes of paper P can be inserted into the cassette 110.

Figure 5:
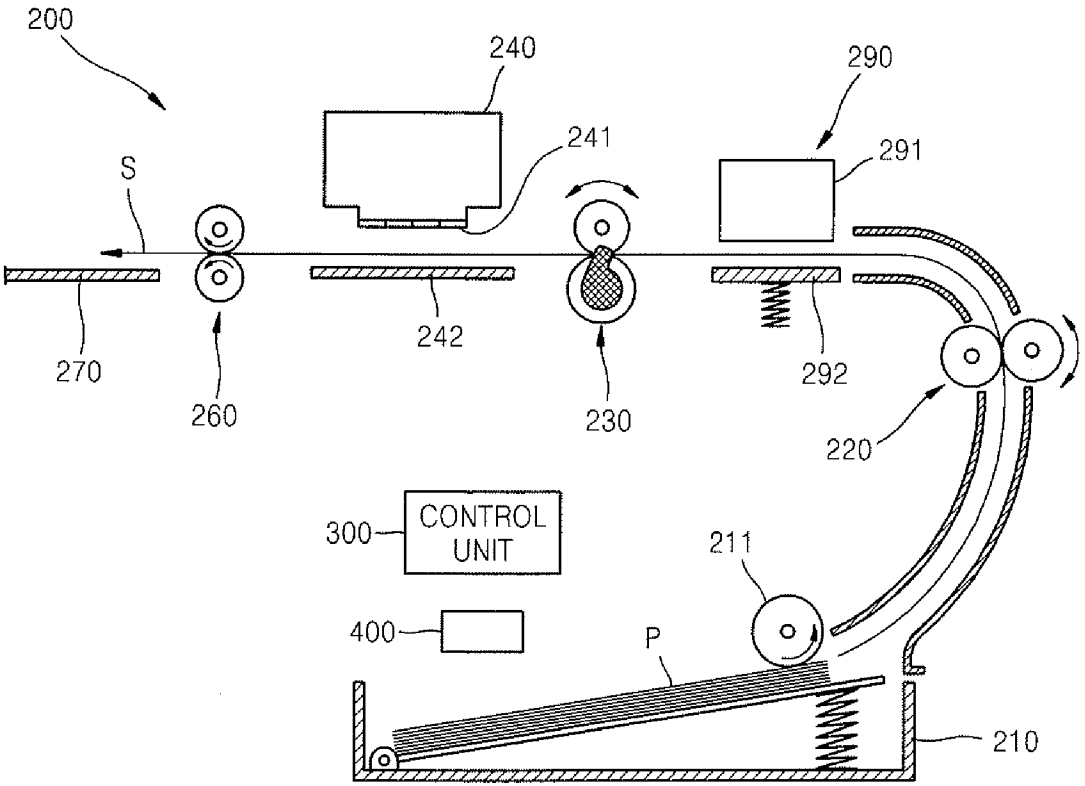
FIG. 5 is a schematic cross-sectional view of the structure of an inkjet image-forming apparatus according to another embodiment of the present general inventive concept.
Figure 6:
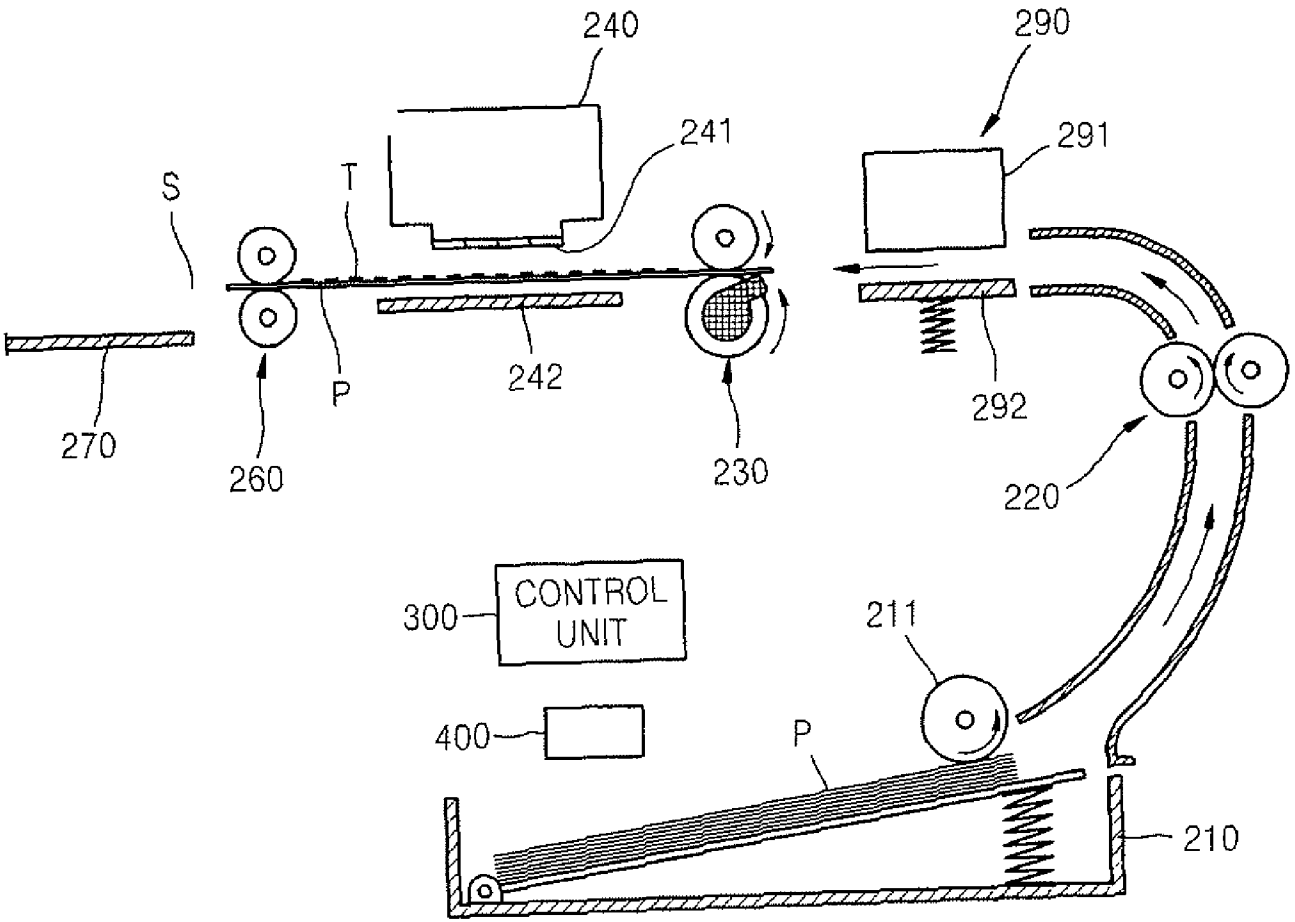
FIGS. 6 through 8 are schematic cross-sectional views illustrating a scanning operation of a test image using the missing nozzle detection unit of FIG. 5, according to another embodiment of the present general inventive concept.
Figure 7:
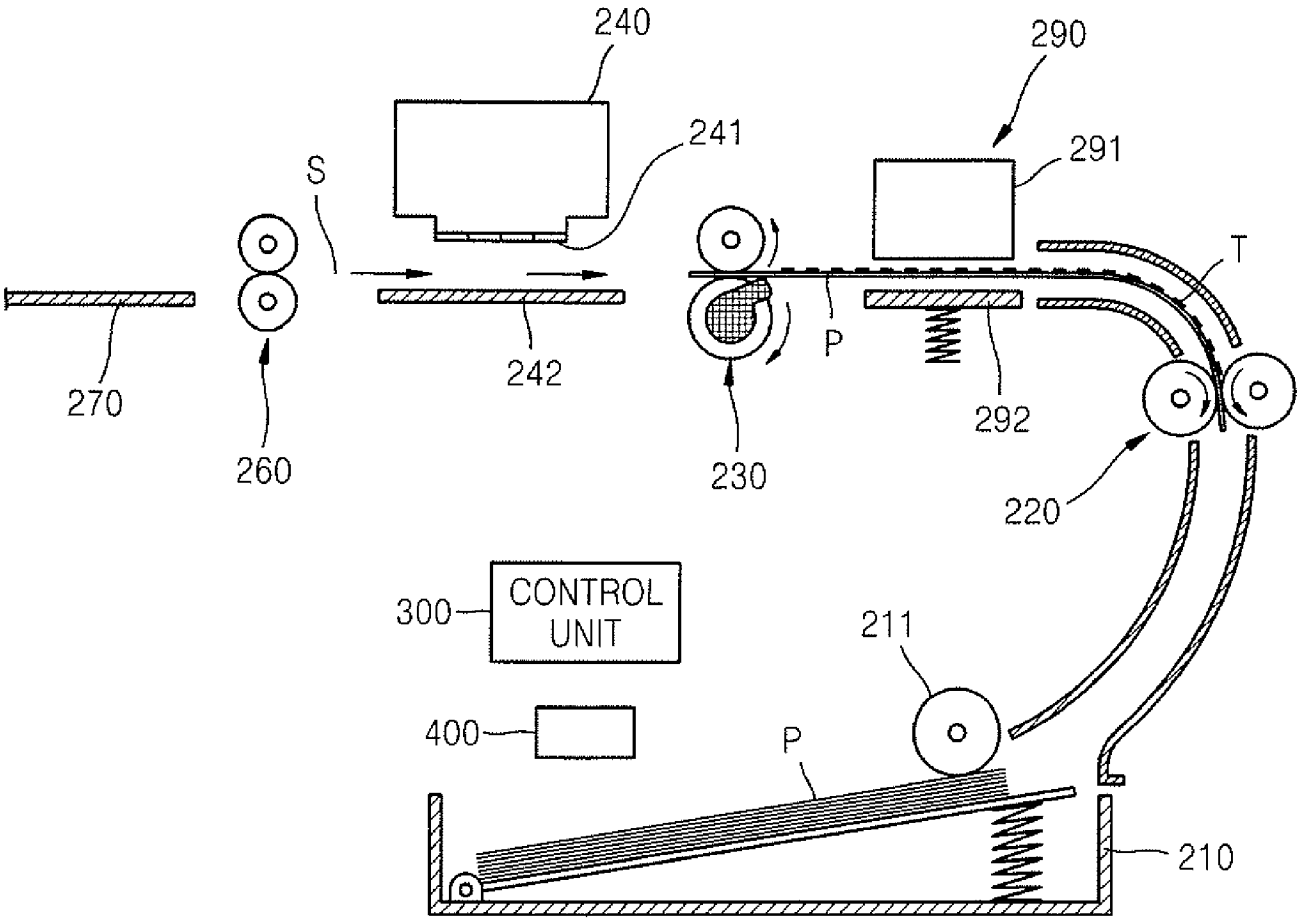
Figure 8:
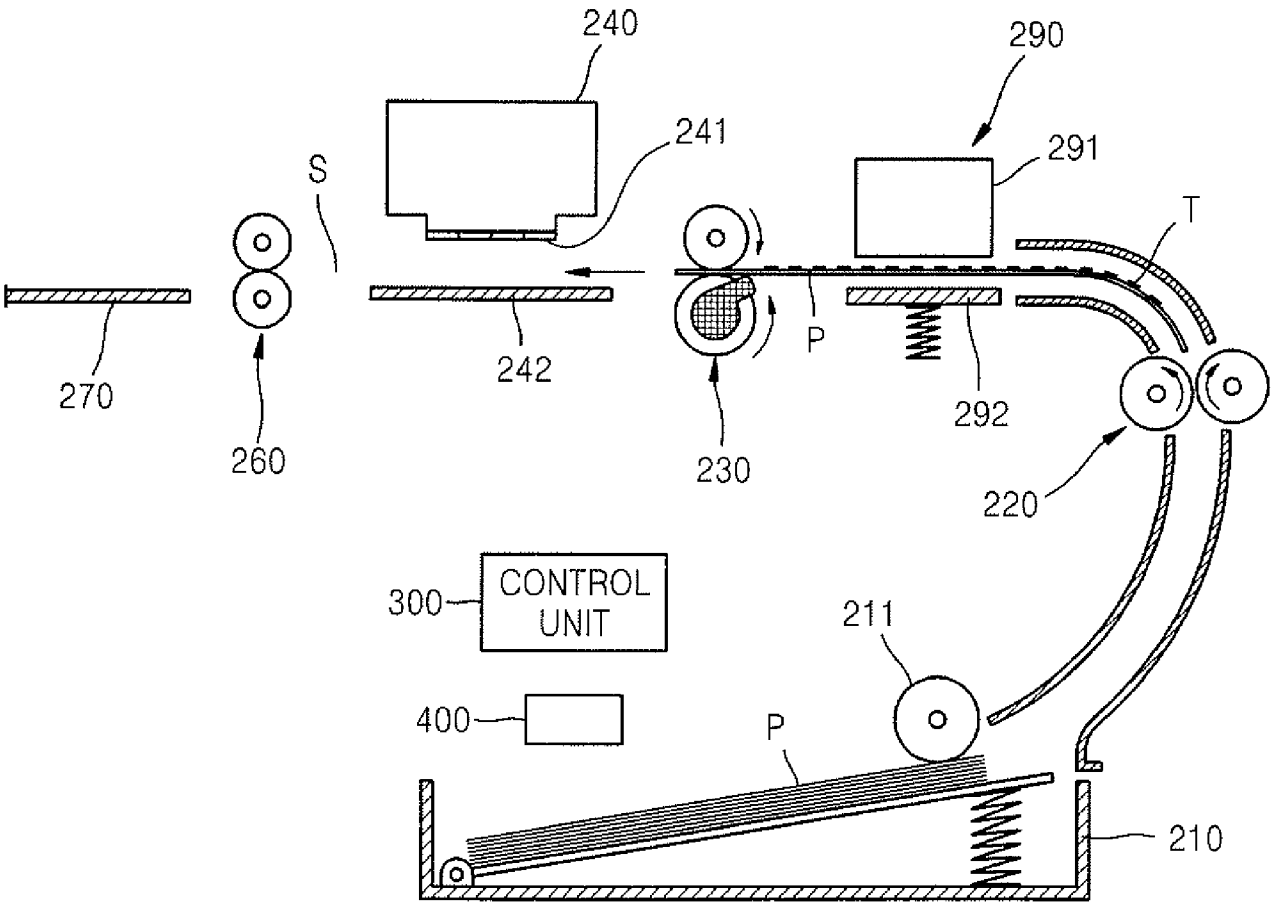

FIG. 5 is a schematic cross-sectional view of the structure of an inkjet image-forming apparatus 200 according to another embodiment of the present general inventive concept. FIGS. 6 through 8 are schematic cross-sectional views illustrating a scanning operation of a test image T using a missing nozzle detection unit 290 of FIG. 5, according to another embodiment of the present general inventive concept.

Referring to FIG. 5, the inkjet image-forming apparatus 200 according to another embodiment of the present includes a cassette 210 an array inkjet head 240, a pair of discharge rollers 260, and the missing nozzle detection unit 290.

The cassette 210 contains a plurality of papers P, and a pick-up roller 211 that picks up each of the sheet papers P is formed on an upper side of the cassette 210. A paper P, picked-up by the pick-up roller 211, is moved along a printing path S to print an image on the paper P. A pair of first transport rollers 220, the missing nozzle detection unit 290, a pair of second transport rollers 230, the array inkjet head 240, and the pair of discharge rollers 260 are sequentially disposed along the printing path S.

The first transport rollers 220 of the pair of first transport rollers 220 contact each other, are disposed between the missing nozzle detection unit 290 and the pick-up roller 211, and are installed to be able to move the paper P in both front and rear directions. The pair of second transport rollers 230 is installed between the array inkjet head 240 and the missing nozzle detection unit 290, and is installed to be able to transport the paper P in both front and rear directions. The pair of second transport rollers 230 can have a registration function to align the paper P.

The pair of first transport rollers 220 and the pair of second transport rollers 230 are installed to be able to move the paper P in both front and rear directions so that the pair of first transport rollers 220 and the pair of second transport rollers 230 can also reversely transport the paper P, on which the test image T is formed, towards the missing nozzle detection unit 290, as will be described later.

The array inkjet head 240 has a length corresponding to a width of the paper P, and includes a plurality of nozzles 241 to eject ink. A supporter 242 that supports the moving paper P is provided on a lower side of the array inkjet head 240 that is fixed, and thus, an image is printed on the paper P by ejecting ink from the nozzles 241 while the paper P passes under the array inkjet head 240.

The pair of discharge rollers 260 discharges the paper P, on which an image is printed, to the outside to stack the paper P on a paper deck 270. In a normal printing operation to form an image on a paper P, the paper P that is picked up by the pick-up roller 211 from the cassette 210 is transported by the pair of first transport rollers 220 and the pair of second transport rollers 230, and the image is formed on the paper P while the paper P passes under the array inkjet head 240. The paper P, on which the image is formed, is discharged by the pair of discharge rollers 260 to be stacked on the paper deck 270.

The missing nozzle detection unit 290 is provided between the pair of first transport rollers 220 and the pair of second transport rollers 230 on the printing path S, and the missing nozzle detection unit 290 scans the test image T, and includes a scan unit 291 that scans the test image T and a pushing unit 292 that is formed on a lower side of the scan unit 291 to push the paper P, on which the test image T is formed, towards the scan unit 291.

Operation of the missing nozzle detection unit 290 will now be described with reference to FIGS. 6 through 8.

Referring to FIG. 6, a paper P, picked up by the pick-up roller 211, is transported along the printing path S by the pair of first transport rollers 220 and the pair of second transport rollers 230, and the test image T is formed on the paper P while the paper P passes under the array inkjet head 240. At this point, an end of the paper P, on which the test image T is formed, may be inserted between the second transport rollers 230, and at this point, the scan unit 291 does not operate.

Referring to FIG. 7, the paper P, on which the test image T is formed, is reversely transported in an opposite direction by rotating the pair of second transport rollers 230 in a reverse direction. At this point, the scan unit 291 does not scan the test image T formed on the paper P. The pair of first transport rollers 220 stop rotating when the first transport rollers 220 hold an end of the paper P on which the test image T is formed.

Referring to FIG. 8, the paper P, on which the test image T is formed, is transported towards the scan unit 291 by rotating the pair of first transport rollers 220 in a reverse direction. The scan unit 291 reads the test image T formed on the paper P, and the pair of second transport rollers 230 transport the paper P on which the test image T is formed along the printing path S after aligning the paper P. The paper P including the test image T of which has been read by the scan unit 291, is discharged to the outside by the pair of discharge rollers 260, and is stacked on the paper deck 270.

As the same manner as in the embodiment of FIGS. 1 through 4, if in the embodiment of FIGS. 5 through 8 a portion of the test image T is not read by the scan unit 291, a control unit 300 recognizes the portion of the test image T that is not read by the scan unit 191 as a defective portion of the nozzles, and thus, performs a calibration operation in response to the detected defective portion of the nozzles. Also in the same manner as in the embodiment of FIGS. 1 through 4, a paper size detection unit 400 may also be included to detect a size of the paper P.

Figure 9:
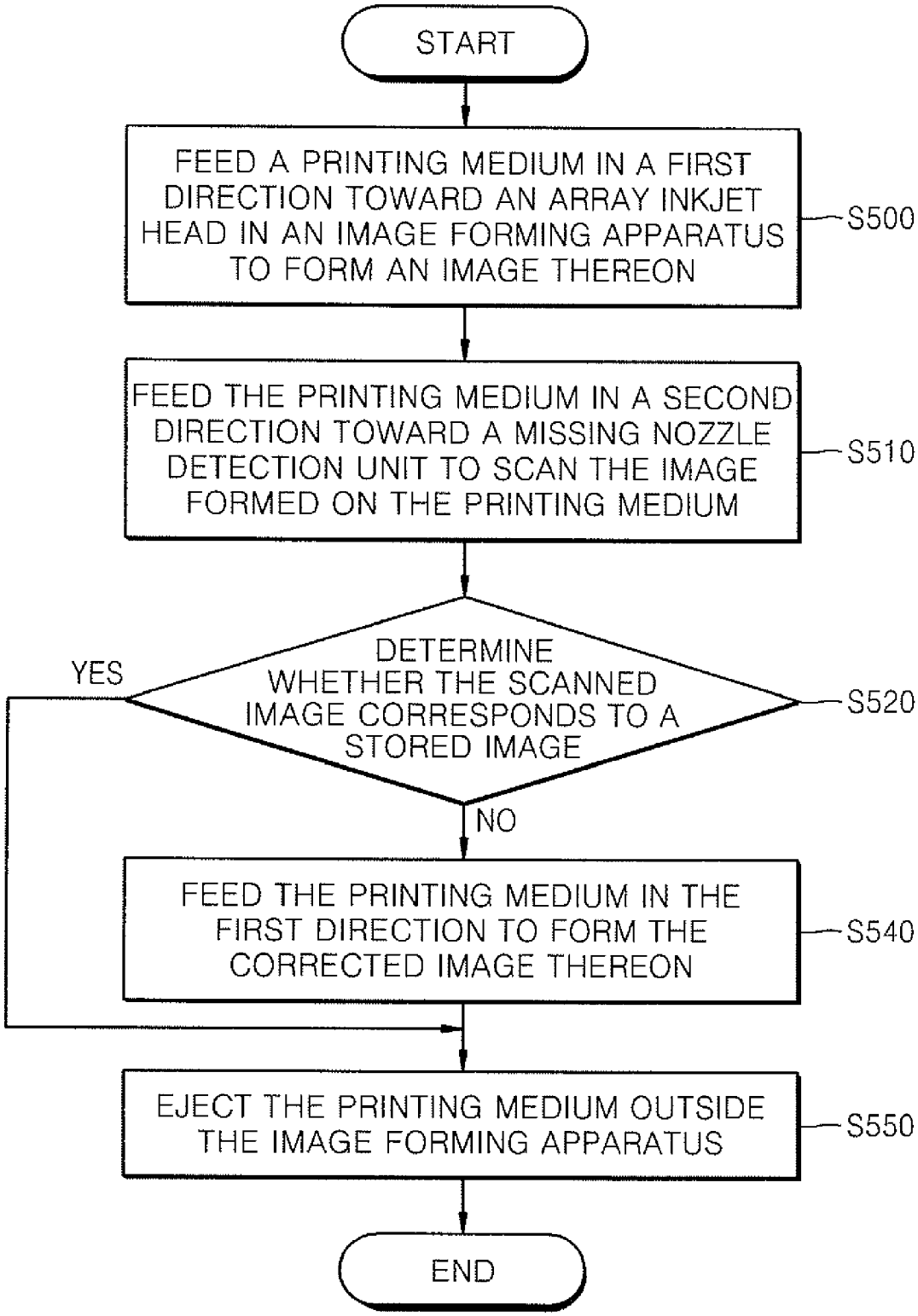
FIG. 9 is a diagram illustrating a method of detecting a defective nozzle head in an image forming apparatus according to an embodiment of the present general inventive concept.

Referring to FIG. 9, the embodiments of FIGS. 1 through 8 can be further described by a method of detecting a defective nozzle head, as follows. In operation S500, the paper P is fed in a first direction toward the array inkjet head 140 (or 240) to form an image thereon. In operation S510, the paper P is fed in a second direction toward the missing nozzle detection unit 190 (or 290) to scan the image formed on the paper P. In operation S520, a determination is made regarding whether the scanned image corresponds to a stored image. If it is determined in operation S520 that the scanned image does correspond to the stored image, then the paper P is ejected outside the image forming apparatus 100 (or 200) in operation S550. If it is determined in operation S520 that the scanned image does not correspond to the stored image, then the paper P is fed again in the first direction to form the corrected image thereon in operation S540. Finally, paper P with the corrected image is ejected outside the image forming apparatus 100 (or 200) in operation S550.

An inkjet image-forming apparatus according to an embodiment of the present general inventive concept has the following advantages.

First, the inkjet image-forming apparatus includes a missing nozzle detection unit that can detect defective nozzles by reading a test image, and performs a calibration operation in response to the detected defective nozzles, thereby improving image quality.

Second, the missing nozzle detection unit is formed on a printing path, thereby resulting in a simple apparatus.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet image-forming apparatus, comprising:

an array inkjet head formed along a printing path through which a paper, on which an image or a test image is formed, is discharged, includes a length corresponding to a width of the paper, and has a plurality of nozzles to eject ink; and a missing nozzle detection unit formed on a missing nozzle detection path connected to the printing path comprising a scan unit to scan the test image formed by the array inkjet head by transporting the paper on which the test image is formed towards the printing path and a pushing unit formed on a lower side of the scan unit to push the paper towards the scan unit.

2. The inkjet image-forming apparatus of claim 1, wherein the missing nozzle detection unit comprises:

a plurality of transport roller units respectively formed on a plurality of sides of the scan unit, and are installed to move a paper in both front and rear directions.

3. The inkjet image-forming apparatus of claim 1, further comprising:

a guide unit formed at a location where the printing path and the missing nozzle detection path are connected to each other to guide the paper picked up from a cassette towards the array inkjet head or to guide the paper, on which the test image is formed, towards the missing nozzle detection unit.

4. The inkjet image-forming apparatus of claim 1, further comprising a pair of transport rollers formed between the array inkjet head and the guide unit to move the paper in both front and rear directions.

5. An inkjet image-forming apparatus, comprising:

an array inkjet head formed along a printing path through which a paper, on which an image or a test image is formed, is discharged, and includes a length corresponding to a width of the paper and a plurality of nozzles to eject ink; and a missing nozzle detection unit formed in front of the array inkjet head along a printing path comprising a scan unit to scan the test image formed by the array inkjet head by transporting the paper, on which the test image is formed, towards the array inkjet head and a pushing unit formed on a lower side of the scan unit to push the paper towards the scan unit.

6. The inkjet image-forming apparatus of claim 5, further comprising a pair of transport rollers disposed closer to the printing path and which are registration rollers to align the paper.

7. An inkjet image-forming apparatus, comprising:

an array inkjet head including a plurality of nozzles to form an image on a printing medium;

a missing nozzle detection unit comprising a scan unit to scan the image formed on the printing medium and a pushing unit configured to push the printing medium toward the scan unit; and a control unit to compare the scanned image with a stored image and to perform a compensation operation on the array inkjet head to correct the image formed on the printing medium if the scanned image does not correspond to the stored image.

8. The inkjet image-forming apparatus of claim 7, wherein the comparison of the scanned image to the stored image results in a determination of which of the plurality of nozzles is defective.

9. The inkjet image-forming apparatus of claim 8, wherein the compensation operation includes shifting the array inkjet head in a predetermined direction such that an operational nozzle replaces the defective nozzle.

10. The inkjet image-forming apparatus of claim 7, wherein:

the array inkjet head prints the image onto the printing medium when the printing medium is fed in a first direction; and the missing nozzle detection unit scans the image printed on the printing medium when the printing medium is fed in a second direction.

11. The inkjet image-forming apparatus of claim 7, further comprising:

a paper size detection unit to detect at least one of a length and a width of the printing medium.

12. The inkjet image-forming apparatus of claim 11, wherein the paper size detection unit sends information corresponding to at least one of the length and the width of the printing medium to the control unit such that the control unit differentiates which of the plurality of nozzles are out of a range of the at least one of the length and the width of the paper.

13. A method of detecting a defective nozzle among a plurality of nozzles in an array inkjet head of an image forming apparatus, the method comprising:

feeding a printing medium in a first direction toward the array inkjet head to form an image thereon;

feeding the printing medium in a second direction toward a missing nozzle detection unit to scan the image formed on the printing medium;

determining whether the scanned image corresponds to a stored image; and performing a compensation operation on the array inkjet head.

14. The method of claim 13, comprising:

feeding the printing medium in the first direction to form the corrected image thereon; and ejecting the printing medium outside the image forming apparatus.

15. The method of claim 13, wherein the determining of whether the scanned image corresponds to the stored image includes:

determining which location of the scanned image does not correspond to the stored image; and determining which of the plurality of nozzles corresponds to the location of the scanned image which does not correspond to the stored image.

16. An image forming apparatus, comprising:

an array inkjet head disposed on a path to form an image on a printing medium; and a detection unit disposed on the path to scan the image of the printing medium and comprising a pushing unit configured to push the printing medium toward the detection unit.

17. The image forming apparatus of claim 16, wherein the path comprises:

a printing path along which the printing medium is fed toward the array inkjet head to form the image, and away from the array inkjet head to be discharged; and a missing nozzle detection path extended from the printing path to scan the image of the printing medium and to discharge the printing medium.

18. The image forming apparatus of claim 16, further comprising:

a roller to direct the printing medium to the detection unit from the inkjet head.

19. The image forming apparatus of claim 16, wherein the detection unit comprises:

a scanner to scan the image.

20. The image forming apparatus of claim 16, wherein the path comprises:

a first path to feed the printing medium from a paper cassette to the array inkjet head;

a second path extended from the first path to from the image on the printing medium;

a third path extended from the second path to discharge the printing medium; and a fourth path extended from the second path such that the detection unit scans the image.

* * * * *